US011385598B2

(12) United States Patent
Zanesco et al.

(10) Patent No.: US 11,385,598 B2
(45) **Date of Patent: *Jul. 12, 2022**

(54) PORTABLE OBJECT COMPRISING A ROTATING CONTROL STEM WHOSE ACTUATION IS DETECTED BY MEANS OF TWO INDUCTIVE SENSORS

(71) Applicant: ETA SA Manufacture Horlogere Suisse, Grenchen (CH)

(72) Inventors: Vittorio Zanesco, Neuchatel (CH); Pascal Lagorgette, Bienne (CH); Pascal Meyer, Neuchatel (CH); Damien Schmutz, Salavaux (CH); Raphael Balmer, Vicques (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 736 days.

This patent is subject to a terminal disclaimer.

(21) Appl. No.: 16/324,597

(22) PCT Filed: Oct. 5, 2017

(86) PCT No.: PCT/EP2017/075415

§ 371 (c)(1),
(2) Date: Feb. 11, 2019

(87) PCT Pub. No.: WO2018/103914

PCT Pub. Date: Jun. 14, 2018

(65) Prior Publication Data

US 2019/0171166 A1 Jun. 6, 2019

(30) Foreign Application Priority Data

Dec. 6, 2016 (EP) ..... 16202478

(51) Int. Cl.
*G04C 3/00* (2006.01)

(52) U.S. Cl.
CPC ..... *G04C 3/004* (2013.01); *G04C 3/005* (2013.01)

(58) Field of Classification Search
CPC ..... G04C 3/004; G04C 3/005; G04C 3/007; G04C 3/14; G04G 21/08; H01H 36/006; H01H 25/06; H01H 19/00
(Continued)

(56) References Cited

U.S. PATENT DOCUMENTS 6,252,825 B1 6/2001 Perotto
7,404,667 B2 * 7/2008 Born ..... G04C 3/004 368/190

(Continued)

FOREIGN PATENT DOCUMENTS

EP 1 930 794 A1 6/2008
EP 2 261 938 A2 12/2010

(Continued)

OTHER PUBLICATIONS

Office Action dated Mar. 15, 2021 in corresponding Korean Patent Application No. 10-2019-7006878 (with English Translation), 7 pages.

(Continued)

*Primary Examiner* — Edwin A. Leon
(74) *Attorney, Agent, or Firm* — Oblon, McClelland, Maier & Neustadt, L.L.P.

(57) ABSTRACT

A portable object including a control stem, actuation of which in rotation can control at least one electronic or mechanical function of the portable object, a magnetized ring driven in rotation by the control stem, rotation of the magnetized ring and position of the magnetized ring being detected by two inductive sensors configured to be sensitive to a variation in magnetic induction in only two directions in space that are parallel to each other or that converge on a (Continued)

same point, with exception of a case in which these two directions are perpendicular to each other.

17 Claims, 12 Drawing Sheets

(58) Field of Classification Search
USPC ..... 368/187
See application file for complete search history.

(56) References Cited

U.S. PATENT DOCUMENTS

| | | | | |
|---|---|---|---|---|
| 7,794,138 | B2 * | 9/2010 | Hilfiker | A61B 5/742 368/190 |
| 8,220,987 | B2 * | 7/2012 | Kimura | G04C 3/004 368/319 |
| 8,305,171 | B2 * | 11/2012 | Kimura | H03K 17/97 335/205 |
| 10,261,476 | B2 * | 4/2019 | Zanesco | G04G 21/00 |
| 2008/0112275 | A1 | 5/2008 | Born et al. | |
| 2010/0309756 | A1 | 12/2010 | Kimura et al. | |
| 2016/0098016 | A1 | 4/2016 | Ely et al. | |
| 2016/0378072 | A1 | 12/2016 | Ely et al. | |

FOREIGN PATENT DOCUMENTS

| | | | |
|---|---|---|---|
| FR | 2 759 792 | A1 | 8/1998 |
| JP | 2001-524206 | A | 11/2001 |
| JP | 2008-122377 | A | 5/2008 |
| JP | 2010-287325 | | 12/2010 |

OTHER PUBLICATIONS

International Search Report dated Jan. 25, 2018 in PCT/EP2017/075415 filed on Oct. 5, 2017.

* cited by examiner

Fig. 2
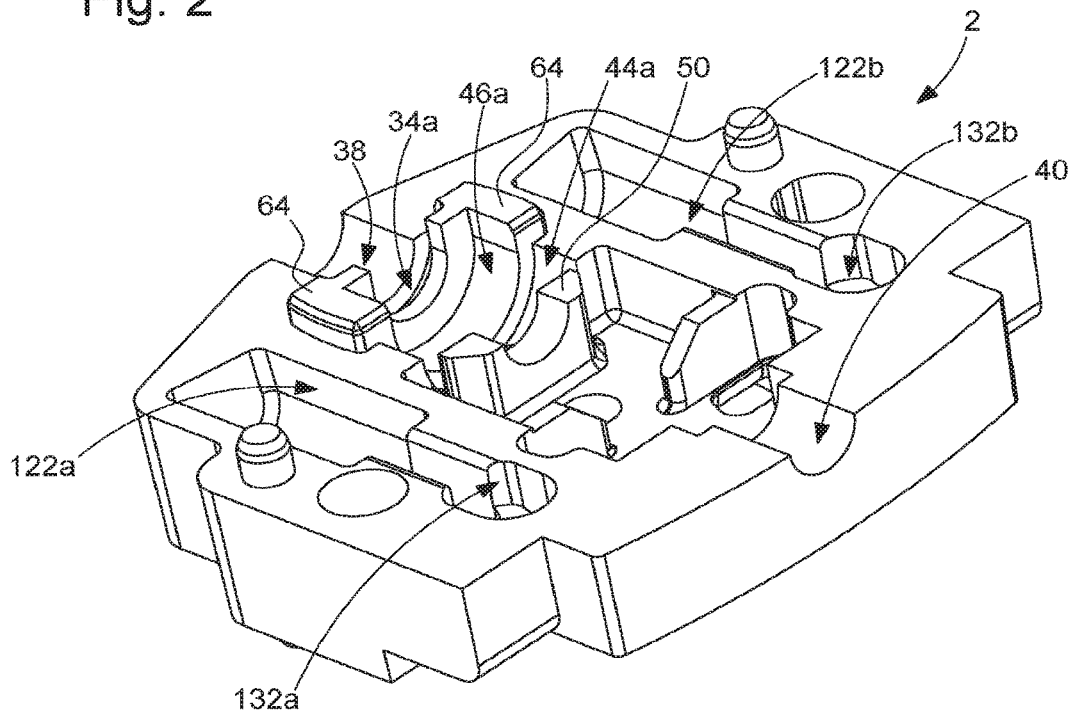
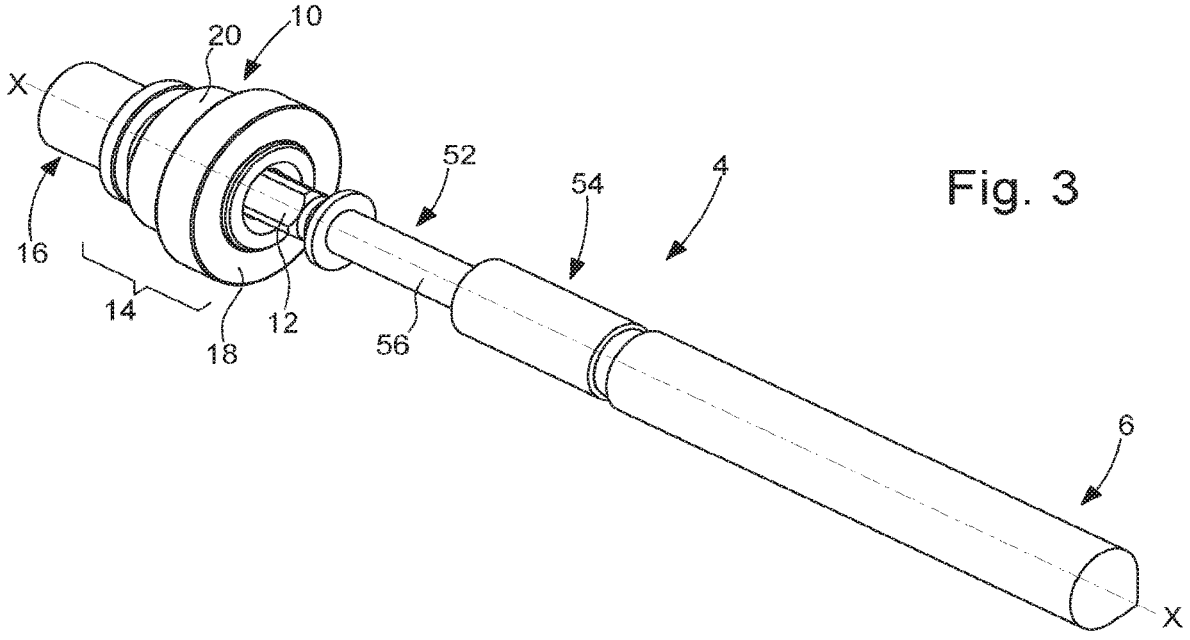
Fig. 3

PORTABLE OBJECT COMPRISING A ROTATING CONTROL STEM WHOSE ACTUATION IS DETECTED BY MEANS OF TWO INDUCTIVE SENSORS

FIELD OF THE INVENTION

The present invention concerns a portable object of small dimensions such as a timepiece, comprising a rotating control stem for controlling at least one electronic or mechanical function of the portable object. More specifically, the invention concerns such a portable object wherein actuation of the rotating control stem is detected by measuring magnetic induction by means of two inductive sensors.

BACKGROUND OF THE INVENTION

The present invention concerns portable objects of small dimensions, such as wristwatches, that comprise a rotating control stem, the actuation of which controls a mechanical or electronic function of the portable object in which the rotating control stem is arranged.

To properly perform the mechanical or electronic function concerned, it must be possible to detect the actuation of the rotating control stem. Among various possible solutions, one consists in measuring the variation in magnetic induction produced by the rotation of a magnet integral with the control stem. To detect this variation in magnetic induction, it is possible to use a magnetic sensor such as a Hall effect sensor which is capable of measuring the value of magnetic induction of the environment in which it is located.

A recurrent problem that arises in the field of detecting the rotation of a control stem by measuring magnetic induction is that of knowing precisely how far and in which direction the control stem is rotated. To overcome this problem, systems have already been proposed that include a pair of magnetic sensors such as magnetoresistors or Hall-effect sensors. In these known systems, the magnetic sensors detect the variation in magnetic induction produced by the rotation of the magnet integral with the control stem in two orthogonal directions in space.

One drawback of such systems lies in the fact that, since the magnetic sensors measure variations in magnetic induction in two orthogonal directions, it is not possible to subtract from the measuring signal produced by the magnetic sensors the effects due to magnetic disturbances outside the portable object when these magnetic disturbances are directed along the axis of measurement of only one of the two magnetic sensors. Indeed, in that case, the other magnetic sensor does not sense the external magnetic disturbance, so the influence of this magnetic disturbance on the two measuring signals is not symmetrical and therefore cannot be eliminated. It is therefore necessary to provide the portable object with an electromagnetic shield, which is particularly cumbersome and costly. Other solutions are known but more particularly intended for measuring the Earth's magnetic field. In such applications, the magnetic sensor or sensors exhibit high sensitivity since the Earth's magnetic field to be measured is very low, typically on the order of 20 to 60 μT. However, these magnetic sensors cannot usually measure magnetic induction in excess of 5 mT, whereas the values associated with magnets of small dimensions frequently reach 100 mT.

SUMMARY OF THE INVENTION

It is an object of the present invention to overcome the aforementioned problems, in addition to others, by providing a portable object comprising a rotating stem for controlling at least one mechanical or electronic function of the portable object, the actuation of the rotating stem being detected in a reliable and reproducible manner by means of inductive sensors.

To this end, the present invention concerns a portable object comprising a control stem, the actuation of which in rotation can control at least one electronic or mechanical function of the portable object, a magnetized ring being driven in rotation by the rotating control stem, the rotation of the control stem and the position of the latter being detected by two inductive sensors arranged to be sensitive to a variation in magnetic induction produced by rotation of the magnetized ring in only two directions in space, which are parallel to each other.

According to other embodiments of the invention which form the subject of the dependent claims:

- the two inductive sensors are arranged at an equal distance from a centre of rotation of the magnetized ring, symmetrically with respect to a plane passing through the centre of rotation of the magnetized ring;
- the two inductive sensors are only sensitive to a variation in magnetic induction in a vertical direction. In other words, the two inductive sensors are sensitive to a variation in magnetic induction in a direction perpendicular to a back of the portable object, the longitudinal axis of symmetry of the control stem extending parallel to said back;
- the two inductive sensors are arranged with respect to the control stem such that, when the magnetized ring rotates as a result of actuation of the control stem, the two inductive sensors produce signals that are phase-shifted with respect to each other by a value comprised between 60° and 120°;
- the portable object includes a frame arranged to serve as a cradle for the control stem, the inductive sensors being disposed inside at least one housing provided in the frame inside which they are held by elastic means;
- the two inductive sensors are disposed inside two distinct housings arranged in the frame;
- the portable object includes a holding plate provided with at least one elastic finger which, by pressure on the inductive sensors, holds the inductive sensors inside the at least one housing in which they are disposed;
- the holding plate is provided with two elastic fingers and the inductive sensors are fixed to a printed circuit sheet on which the elastic fingers press at the locations where the inductive sensors are fixed;
- the printed circuit sheet is flexible and folded down onto the frame so that the inductive sensors are disposed inside the housings;
- the elastic fingers immobilise the inductive sensors in a vertical direction;
- the elastic fingers are arranged to force the inductive sensors against the bottom of the housings inside which they are disposed.

An 'inductive sensor' means a sensor that transforms a magnetic field passing therethrough into electric voltage due to the phenomenon of induction defined by Lenz's law and Faraday's law. By way of example, this may be a Hall effect sensor or a magnetoresistance component of the AMR (anisotropic magnetoresistance), GMR (giant magnetoresistance) or TMR (tunneling magnetoresistance) type.

As a result of these features, the present invention provides a portable object in which detection of the rotation of a control stem controlling at least one mechanical or electronic function of the portable object is obtained by measuring the variation in magnetic induction caused by rotation of a magnet driven by the control stem by means of two inductive sensors. These two inductive sensors are arranged to be sensitive to a variation in magnetic induction in only one direction in space. It is clear that the magnetic induction produced by the environment in which the portable object is located is added to the magnetic induction produced by the magnetized ring. By teaching that the pair of inductive sensors are arranged so that the sensors exhibit sensitivity to magnetic induction in only a single direction, the present invention makes it possible, via a suitable signal processing treatment, to completely eliminate from the measurement result the influence of the magnetic induction of the environment in which the portable object is located. In fact, as a result of these measures, the case where magnetic disturbances produced by the environment in which the portable object is located are directed along the axis of measurement of only one of the two inductive sensors cannot occur. Consequently, the case where one of the two inductive sensors does not sense the external magnetic disturbance is precluded, so that the influence of the external magnetic disturbance on the measurement signals is the same for both inductive sensors and can therefore be eliminated. It is consequently unnecessary to magnetically shield the portable object to avoid the influence of magnetic induction outside the portable object, which saves space. This is very advantageous in the case of a portable object of small dimensions in which the available space is necessarily very limited. The lack of shielding also simplifies the manufacture of the portable object and thus ensures better reliability and a lower cost price.

The invention also concerns a method for detecting a position of a control stem, the actuation of which in rotation controls an electronic or mechanical function of a portable object provided with the control stem, a magnetized ring being driven in rotation by the control stem, the rotation of the control stem and the position of the latter being detected by two inductive sensors arranged to be sensitive to a variation in magnetic induction produced by rotation of the magnetized ring in only one direction in space, the method comprising the step which consists in calculating the arctangent function of the ratio between the signals produced by each of the inductive sensors to determine the direction of rotation and the position of the control stem.

As a result of these features, it is possible, regardless of the direction of rotation of the control stem, to determine the absolute position of the control stem, i.e. it is possible at any time to know the angular position of the stem. The resolution of the position detection measurement of the control stem is thus high and reproducible from one object to another, even in the case of large scale production.

BRIEF DESCRIPTION OF THE DRAWINGS

Other features and advantages of the present invention will appear more clearly from the following detailed description of an example embodiment of a portable object according to the invention, this example being given purely by way of non-limiting illustration with reference to the annexed drawing, in which:

FIG. 2 is a top, perspective view of the lower frame.

FIG. 3 is a perspective view of the control stem which, from right to left in the Figure, extends from its rear end to its front end.

DETAILED DESCRIPTION OF ONE EMBODIMENT OF THE INVENTION

The present invention proceeds from the general inventive idea which consists in detecting the rotation of a control stem mounted in a portable object of small dimensions, such as a timepiece, in a reliable and reproducible manner from one portable object to another, particularly in the case of mass production. To overcome this problem, it is proposed to drive a magnetized ring in rotation via the control stem and to detect the variation in magnetic induction caused by rotation of the ring by means of a pair of inductive sensors. These two inductive sensors are arranged to be sensitive each to fluctuations in magnetic induction in only one direction in space. Consequently, the influence of magnetic induction outside the portable object is the same on the measuring signals of both inductive sensors, so that, via a suitable signal processing process, it is possible to completely eliminate from the measurement result the influence of the magnetic induction of the environment in which the portable object is located.

The invention also concerns a method for detecting the position and the direction of rotation of a rotating control stem which consists in calculating the arctangent function of the ratio between the signals produced by two inductive sensors arranged to be sensitive to fluctuations in magnetic induction in two directions in space parallel to each other. Since the magnetic induction of the environment in which the portable object is located only exercises an influence on the sensing elements of the two inductive sensors in one direction in space, calculating the arctangent function of the ratio between the signals produced by these two inductive sensors can eliminate the signal component due to the influence of magnetic induction outside the portable object.

In all that follows, the back-to-front direction is a rectilinear direction which extends horizontally along longitudinal axis of symmetry X-X of the control stem from the external actuation crown towards the interior of the portable object equipped with the control device, parallel to a plane in which a back of the portable object extends. Thus, the control stem will be pushed from back to front, and will be pulled from front to back. Further, the vertical direction is a direction that extends perpendicularly to the plane in which the control stem extends.

Figure 1:
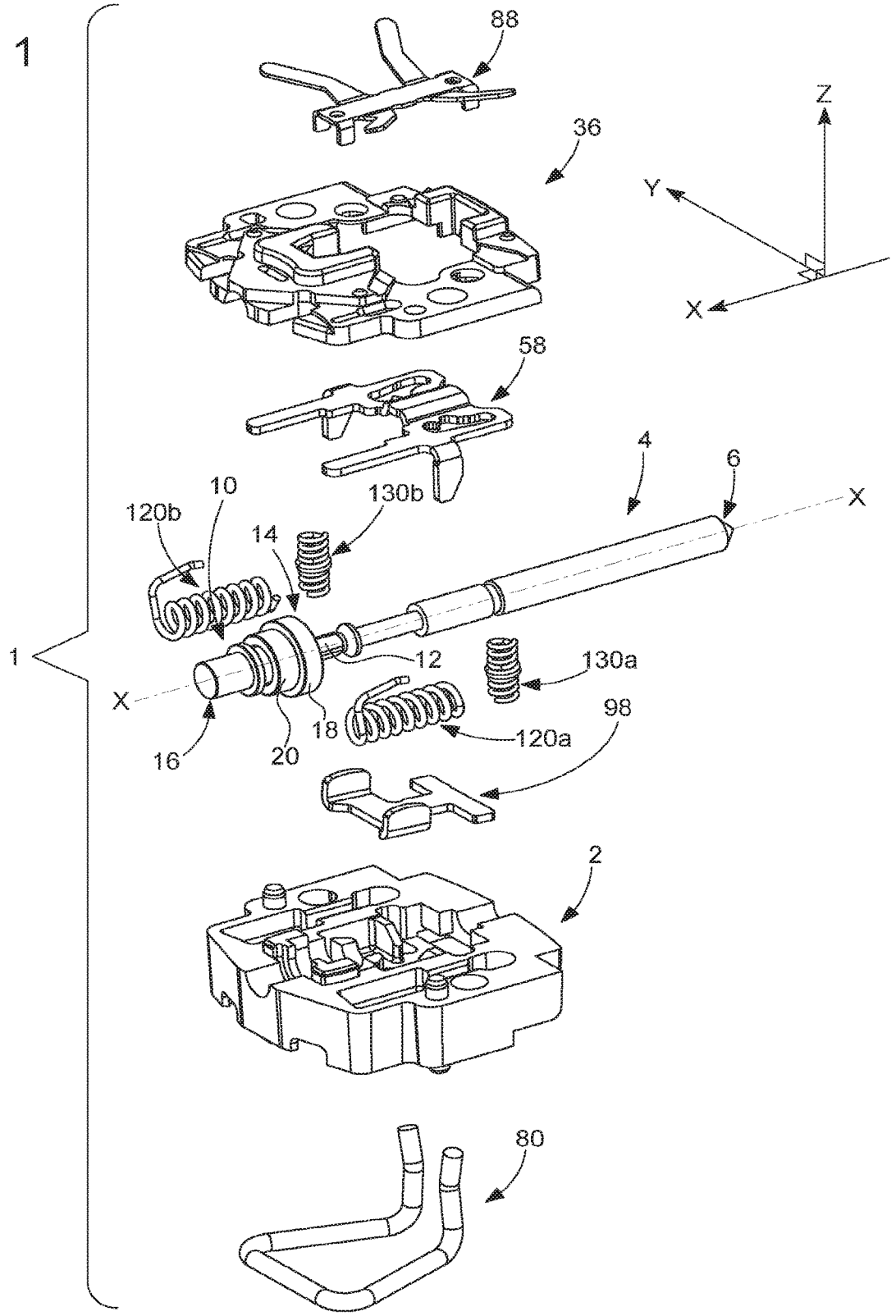
FIG. 1 is a perspective view, in an unassembled state, of a device for controlling at least one electronic function of a portable object of small dimensions.

FIG. 1 is a perspective view, in an unassembled state, of a device for controlling at least one electronic function of a portable object of small dimensions, such as a wristwatch. Designated as a whole by the general reference number 1, this control device includes a lower frame 2, for example made of an injected plastic material or of a non-magnetic metallic material such as brass, and serves as a cradle for a control stem 4, preferably of elongated and substantially cylindrical shape, provided with a longitudinal axis of symmetry X-X. This control stem 4 is arranged to slide from front to back and from back to front along its longitudinal axis of symmetry X-X and/or to rotate about said same axis of longitudinal symmetry X-X in the clockwise and anti-clockwise direction.

Figure 20:
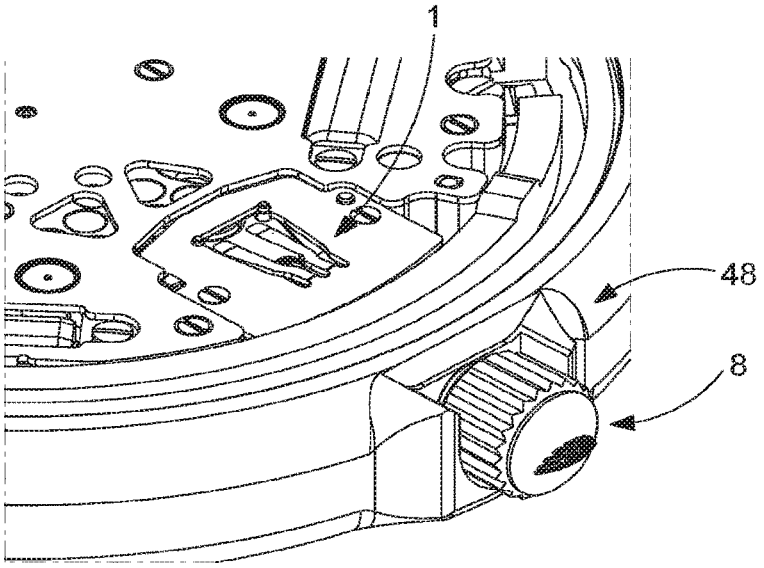
FIG. 20 is a perspective view of the control device installed in a portable object.

At a rear end 6, which will be located outside the portable object once the latter is equipped with a control device 1, control stem 4 will receive an actuation crown 8 (see FIG. 20).

At a front end 10, which will be located inside control device 1 once the latter is assembled, control stem 4 has, for example, a square section 12 and receives in succession a magnetic assembly 14 and a smooth bearing 16.

Figure 4:
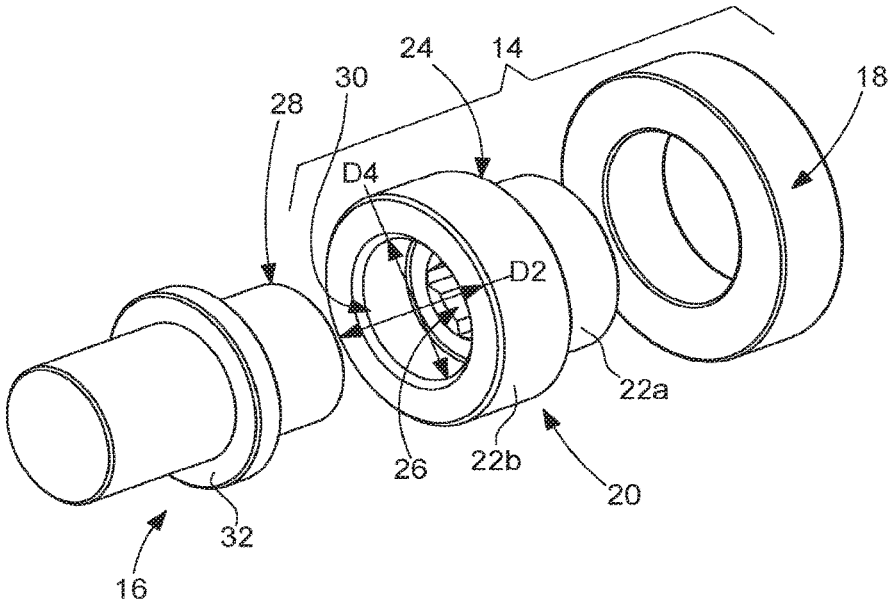
FIG. 4 is a perspective view, in an unassembled state, of the smooth bearing and of the magnetic assembly formed of a support ring and a magnetized ring.
Figure 5:
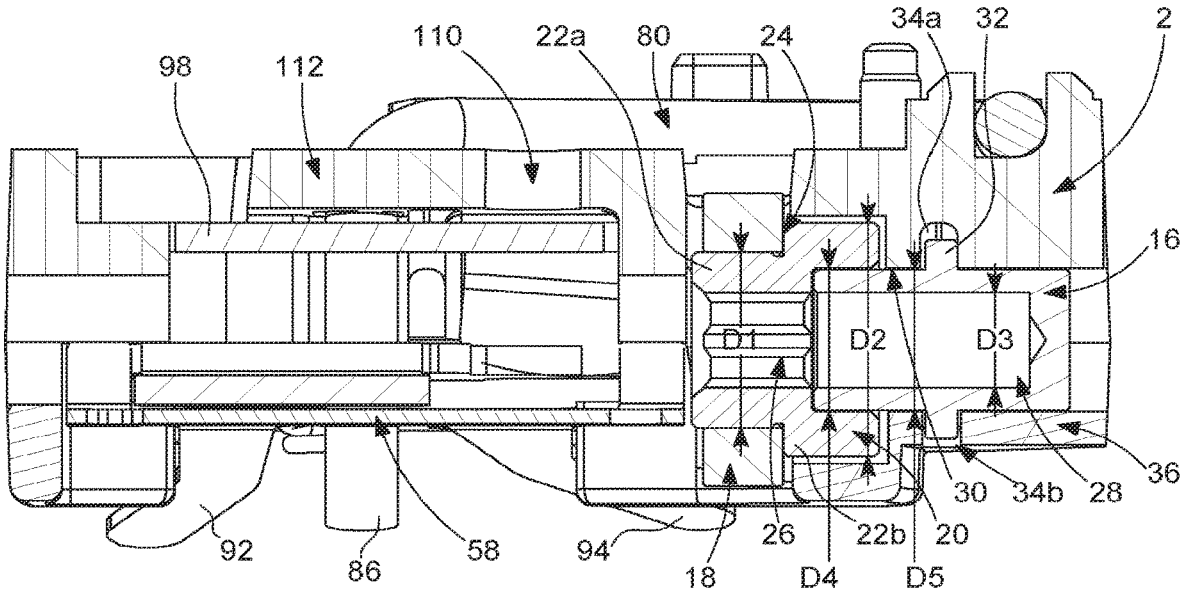
FIG. 5 is a longitudinal cross-sectional view along a vertical plane of a control device inside which are arranged the smooth bearing and the magnetic assembly formed of the support ring and the magnetized ring.

Magnetic assembly 14 includes a magnetized ring 18 and a support ring 20, on which magnetized ring 18 is fixed, typically by adhesive bonding (see FIG. 4). Support ring 20 is a component of generally cylindrical shape. As seen in FIG. 5, support ring 20 has, from back to front, a first section 22*a* having a first external diameter D1 on which is engaged magnetized ring 18, and a second section 22*b* having a second external diameter D2 greater than first external diameter D1 and which delimits a shoulder 24 against which magnetized ring 18 abuts. The first section 22*a* of support ring 20 is pierced with a square hole 26 which is adapted in shape and size to square section 12 of control stem 4 and forms with control stem 4 a sliding pinion type system. In other words, support ring 20 and magnetized ring 18 remain immobile when control stem 4 is made to slide axially. However, control stem 4 drives support ring 20 and magnetized ring 18 in rotation when control stem 4 is rotated. It is clear from the foregoing that magnetized ring 18, carried by support ring 20, is not in contact with control stem 4 which makes it possible to protect it in the event of shocks applied to the portable object equipped with a control device 1.

Smooth bearing 16 defines (see FIG. 5) a cylindrical housing 28 whose first internal diameter D3 is very slightly greater than the diameter of the circle in which is inscribed square section 12 of control stem 4, to allow control stem 4 to slide axially and/or to rotate inside this cylindrical housing 28. Smooth bearing 16 thus ensures perfect axial guiding of control stem 4.

It is noted that the square hole 26 provided in first section 22*a* of support ring 20 is extended towards the front of control device 1 by an annular hole 30 whose second internal diameter D4 is fitted onto third external diameter D5 of smooth bearing 16. Support ring 20 is thus fitted for free rotation on smooth bearing 16 and moves into axial abutment against smooth bearing 16, which ensures the perfect axial alignment of these two components and makes it possible to correct any problems of concentricity that may be caused by a sliding pinion type coupling.

Figure 6:
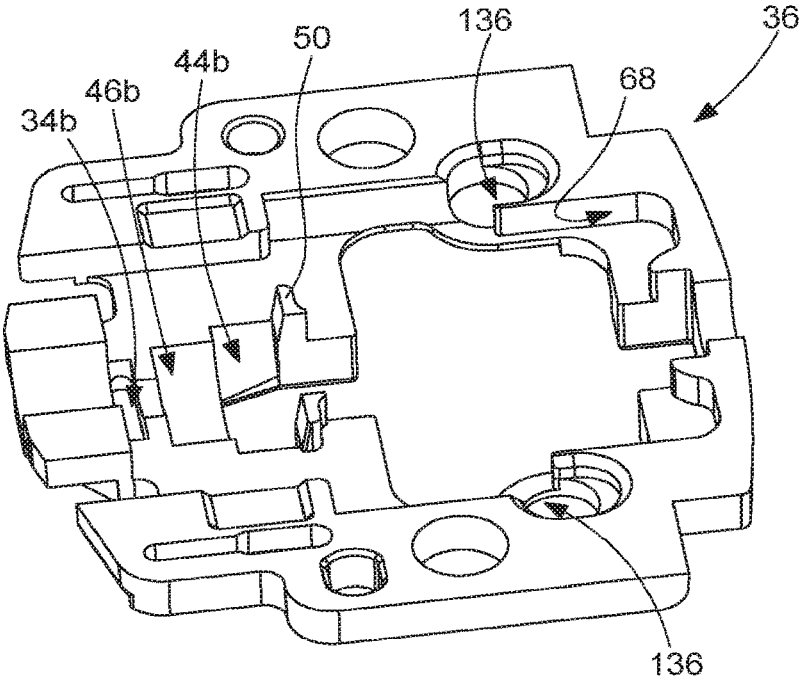
FIG. 6 is a bottom, perspective view of the upper frame.

It is observed that, for axial immobilization thereof, smooth bearing 16 is provided on its outer surface with a circular collar 32 which projects into a first groove 34*a* and into a second groove 34*b*, respectively arranged in lower frame 2 (see FIG. 2) and in an upper frame 36 (see FIG. 6), arranged to cover lower frame 2 and, for example, made of an injected plastic material or of a non-magnetic material, such as brass. These two lower and upper frames 2 and 36 will be described in detail below.

It is important to note that the magnetic assembly 14 and smooth bearing 16 described above are indicated purely for illustrative purposes. Indeed, smooth bearing 16, for example made of steel or brass, is arranged to prevent control stem 4, for example made of steel, rubbing against lower and upper frames 2 and 36, and causing wear of the plastic material of which these two lower and upper frames 2 and 36 are typically made. However, in a simplified embodiment, it is possible to envisage not using such a smooth bearing 16 and arranging for control stem 4 to be directly carried by lower frame 2.

Likewise, magnetized ring 18, and support ring 20 on which magnetized ring 18 is fixed, are intended for the case where rotation of control stem 4 is detected by a local variation in the magnetic field induced by the pivoting of magnetized ring 18. It is, however, entirely possible to envisage replacing magnetic assembly 14, for example with a sliding pinion which, according to its position, will for example control the winding of a mainspring or the time-setting of a watch equipped with control device 1.

It is also important to note that the example of control stem 4 provided on one part of its length with a square section is given purely for illustrative purposes. Indeed, in order to drive magnetic assembly 14 in rotation, control stem 4 may have any type of section other than a circular section, for example triangular or oval.

Lower frame 2 and upper frame 36, the combined assembly of which defines the external geometry of control device 1 are, for example, of generally parallelepiped shape. Lower frame 2 forms a cradle which receives control stem 4. To this end (see FIG. 2), lower frame 2 includes, towards the front, a first receiving surface 38 of semicircular profile, which serves as a seat for smooth bearing 16 and in which is provided the first groove 34*a* which receives circular collar 32. Both axial and rotational immobilization of smooth bearing 1 are thus ensured.

Figure 21:
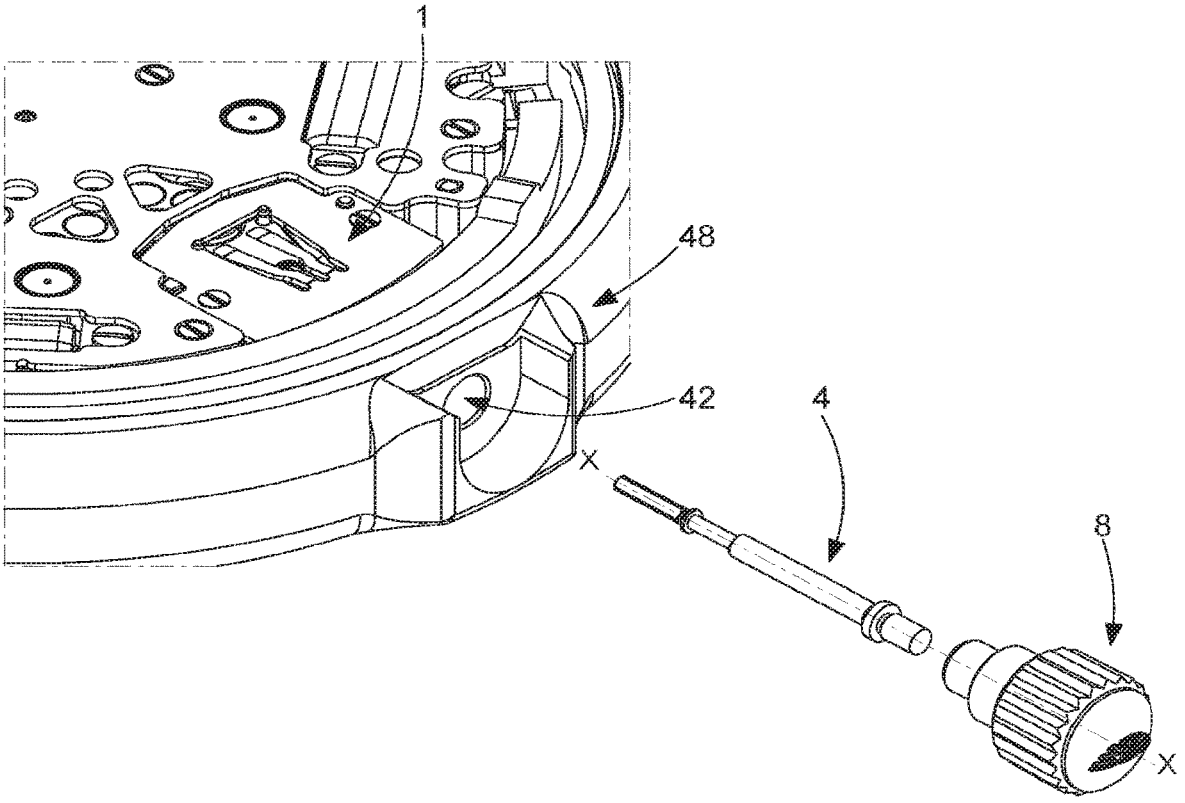
FIG. 21 is a similar view to that of FIG. 20, with the control stem removed from the portable object.

Lower frame 2 further includes, towards the back, a second receiving surface 40, whose semicircular profile is centred on longitudinal axis of symmetry X-X of control stem 4, but whose diameter is greater than that of control stem 4. It is important to understand that control stem 4 only rests on second receiving surface 40 at the stage when the assembled control device 1 is tested prior to being integrated in the portable object. At this assembly stage, control stem 4 is inserted into control device 1 for test purposes and extends horizontally, supported and axially guided by smooth bearing 16 at its front end 10 and via second receiving surface 40 at its rear end 6. However, once control device 1 is integrated in the portable object, control stem 4 passes through a hole 42 provided in case middle 48 of the portable object in which it is guided and supported (see FIG. 21) and which is delimited downwardly by a back 49.

Third and fourth clearance surfaces 44*a* and 46*a* of semicircular profile are also provided in lower frame 2 and complementary clearance surfaces 44*b* and 46*b* (see FIG. 6) are provided in upper frame 36 for receiving magnetic assembly 14, formed of magnetized ring 18 and of its support ring 20. It will be noted that magnetized ring 18 and its support ring 20 are not in contact with third and fourth clearance surfaces 44*a* and 46*a* and complementary clearance surfaces 44*b* and 46*b* when control device 1 is assembled and mounted in the portable object. It is also noted that third clearance surface 44*a* and its corresponding complementary clearance surface 44*b* are delimited by an annular collar 50 for axially locking magnetic assembly 14.

As visible in FIG. 3, behind square section 12, control stem 4 has a cylindrical section 52 whose diameter is comprised between the diameter of the circle in which is inscribed square section 12 of control stem 4 and the POT text as filed primitive diameter of a rear section 54 of said control stem 4, at the end of which is fixed actuation crown 8. This cylindrical section 52 of reduced diameter forms a groove 56 inside which is placed a position indexing plate 58 for control stem 4 (see FIG. 7A). To this end, position indexing plate 58 has a curved portion 60 which follows the profile of reduced diameter cylindrical section 52. Position indexing plate 58 may be, for example, obtained by stamping a thin, electrically conductive metal sheet. However, it is also possible to envisage making position indexing plate 58, for example, by moulding a hard plastic material loaded with conductive particles. The engagement of position indexing plate 58 in groove 56 ensures the coupling in translation, from front to back and from back to front, between control stem 4 and position indexing plate 58. However, as will become clearer below, position indexing plate 58 is free with respect to control stem 4 in a vertical direction z perpendicular to the longitudinal axis of symmetry X-X of control stem 4.

Figure 7A:
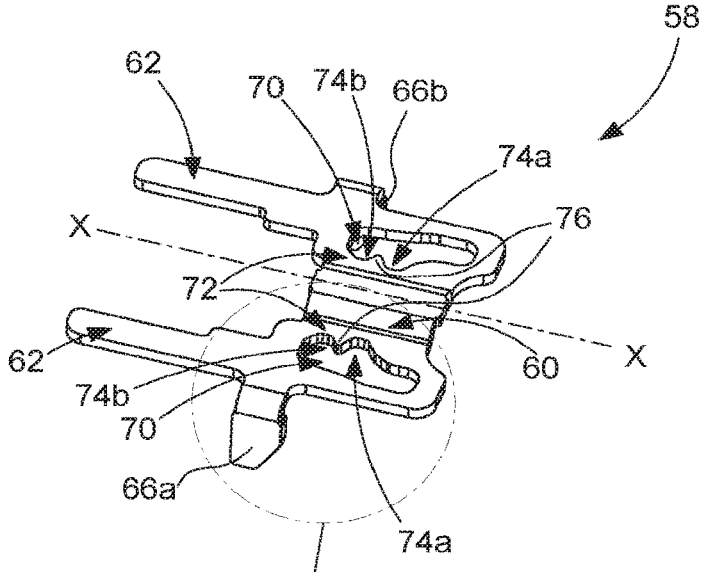
FIG. 7A is a top, perspective view of the plate for indexing the position of the control stem.

As visible in FIG. 7A, position indexing plate 58 is a substantially flat and generally U-shaped part. This position indexing plate 58 includes two substantially rectilinear guide arms 62 which extend parallel to each other and which are connected to each other by curved portion 60. These two guide arms 62 are axially guided, for example, against two studs 64 arranged in lower frame 2 (see in particular FIG. 2). Guided by its two guide arms 62, position indexing plate 58 slides along a rim 68 arranged in upper frame 36 and whose perimeter corresponds to that of position indexing plate 58 (see FIG. 6). Position indexing plate 58 also includes two fingers 66*a*, 66*b* which extend vertically downwards on either side of the two guide arms 62. In sliding along rim 68, position indexing plate 58 has the function of ensuring the translational guiding of control stem 4 from front to back and from back to front. Fingers 66*a*, 66*b*, are intended, in particular, to prevent position indexing plate 58 from bracing when the latter moves in translation.

Figure 7B:
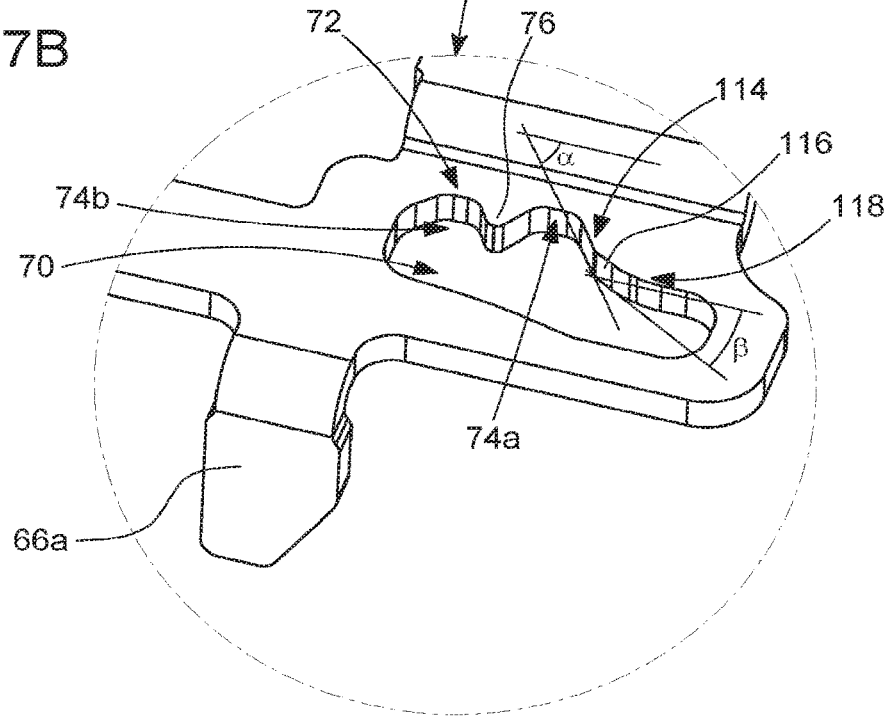
FIG. 7B is a larger scale view of the area encircled in FIG. 7A.

Two apertures 70 exhibiting an approximately rectangular contour are provided in guide arms 62 of position indexing plate 58 (see in particular FIG. 7B). These two apertures 70 extend symmetrically on either side of longitudinal axis of symmetry X-X of control stem 4. The sides of the two apertures 70 closest to longitudinal axis of symmetry X-X of control stem 4 have a cam path 72 of substantially sinusoidal shape, formed of a first and a second recess 74*a*, 74*b* separated by a peak 76.

Figure 8:
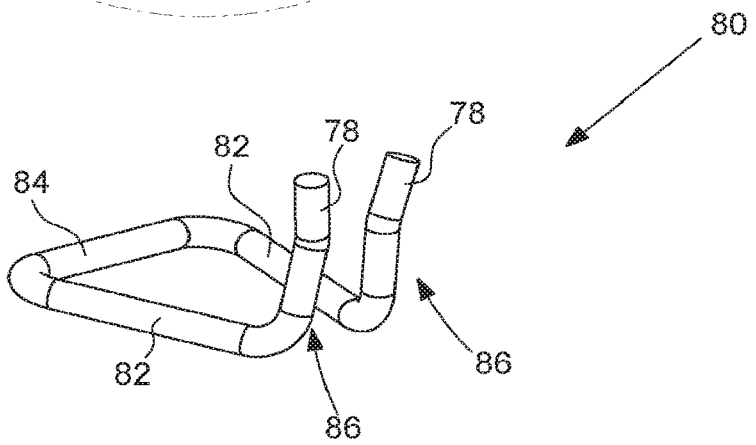
FIG. 8 is a perspective view of the positioning spring arranged to cooperate with the plate for indexing the position of the control stem.

The two apertures 70 provided in guide arms 62 are intended to receive the two ends 78 of a positioning spring 80 (see FIG. 8). This positioning spring 80 is generally U-shaped with two arbors 82 which extend in a horizontal plane and which are connected to each other by a base 84. At their free end, the two arbors 82 are extended by two substantially rectilinear arms 86 which stand upright. Positioning spring 80 is intended to be mounted in control device 1 through the bottom of lower frame 2, so that ends 78 of arms 86 project into apertures 70 of position indexing plate 58. It will be seen below that the cooperation between position indexing plate 58 and positioning spring 80 makes it possible to index the position of control stem 4 between an unstable pushed-in position T0 and two stable positions T1 and T2.

Figure 9:
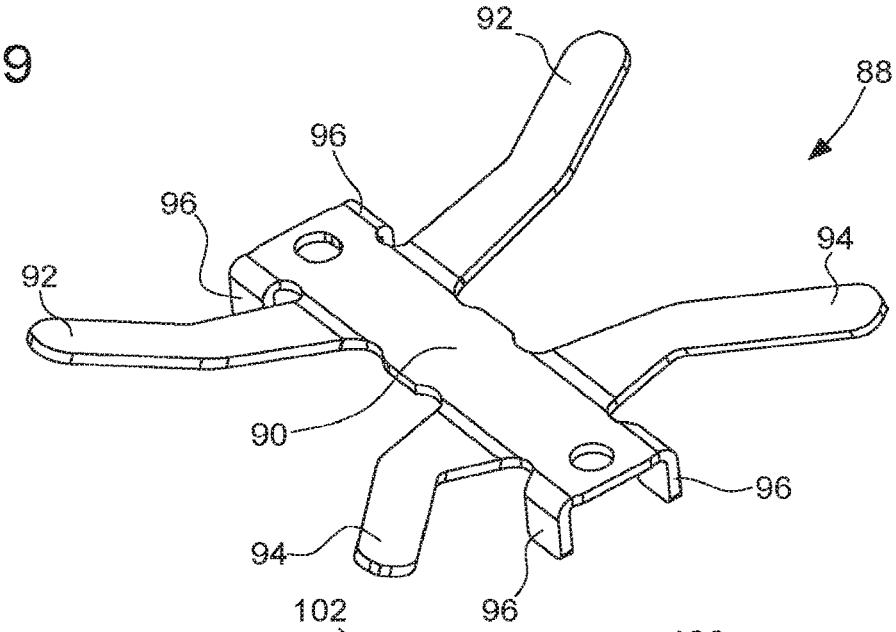
FIG. 9 is a top, perspective view of the spring for limiting the displacement of the control stem position indexing plate.
Figure 11:
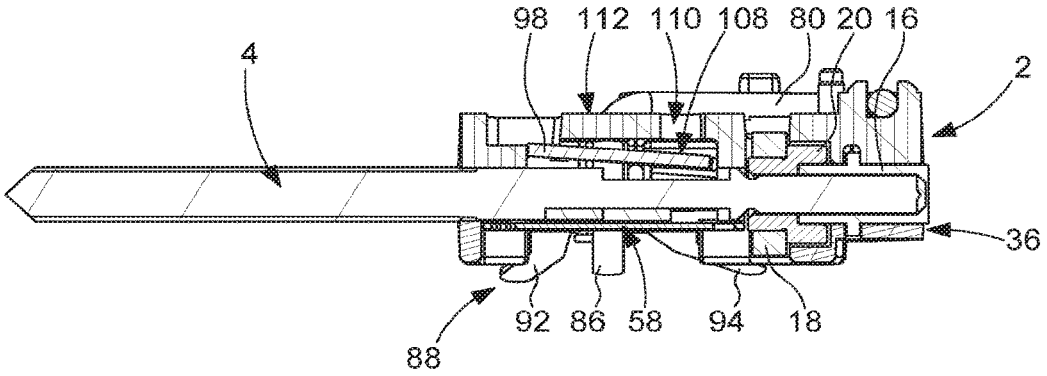
FIG. 11 is a longitudinal cross-sectional view of one part of the control device showing the hole into which a pointed tool is inserted to release the control stem from the position indexing plate.

It was mentioned above that position indexing plate 58 is coupled in translation to control stem 4, but that it is free with respect to control stem 4 in the vertical direction z. It is thus necessary to take steps to prevent position indexing plate 58 disengaging from control stem 4 in normal conditions of use, for example under the effect of gravity. To this end (see FIGS. 9 and 11), a spring 88 for limiting the displacement of position indexing plate 58 in vertical direction z is placed above and at a short distance from position indexing plate 58. Displacement limiting spring 88 is captive between lower frame 2 and upper frame 36 of control device 1, but is not, in normal conditions of use, in contact with position indexing plate 58, which prevents parasitic friction forces being exerted on control stem 4, which would make the latter difficult to operate and cause problems of wear. Displacement limiting spring 88 is, however, sufficiently close to position indexing plate 58 to prevent the latter being inadvertently uncoupled from control stem 4.

Displacement limiting spring 88 includes a substantially rectilinear central portion 90 from the ends of which extend two pairs of elastic arms 92 and 94. These elastic arms 92 and 94 extend on either side of central portion 90 of displacement limiting spring 88, upwardly away from the horizontal plane in which central portion 90 extends. As these elastic arms 92 and 94 are compressed when upper frame 36 is joined to lower frame 2, they impart elasticity to displacement limiting spring 88 along vertical direction z. Between the pairs of elastic arms 92 and 94 there is also provided one pair, and preferably two pairs, of stiff lugs 96 which extend perpendicularly downwards on either side of central portion 90 of displacement limiting spring 88. These stiff lugs 96 which move into abutment on lower frame 2 when upper frame 36 is placed on lower frame 2, ensure that a minimum space is provided between position indexing plate 58 and displacement limiting spring 88 in normal operating conditions of control device 1.

Displacement limiting spring 88 guarantees the dismantability of control device 1. Indeed, in the absence of displacement limiting spring 88, position indexing plate 58 would have to be integral with control stem 4 and, consequently, control stem 4 could no longer be dismantled. If control stem 4 cannot be dismantled, the movement of the timepiece equipped with control device 1 cannot be dismantled either, which is inconceivable, particularly in the case of an expensive timepiece. Thus, when control device 1, formed by joining lower and upper frames 2 and 36, is mounted inside the portable object and control stem 4 is inserted into control device 1 from outside the portable object, control stem 4 slightly lifts position indexing plate 58 against the elastic force of displacement limiting spring 88. If control stem 4 continues to be pushed forwards, there comes a moment when position indexing plate 58 drops into groove 56 under the effect of gravity. Control stem 4 and position indexing plate 58 are then coupled in translation.

Figure 10:
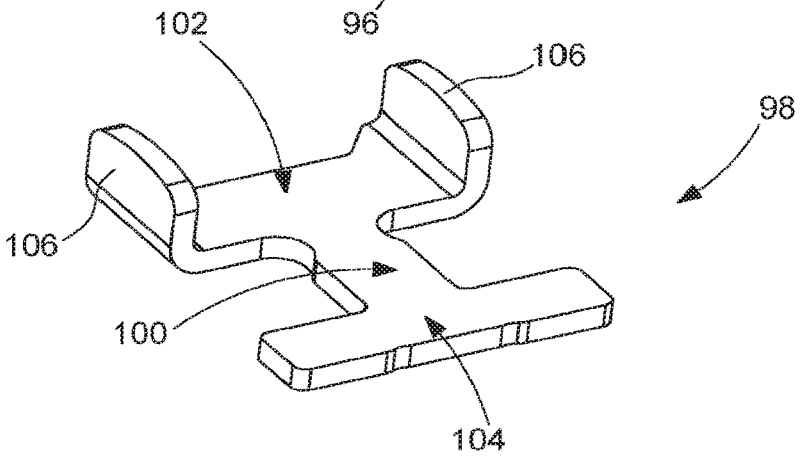
FIG. 10 is a perspective view of the disassembly plate.

A disassembly plate 98 is provided to allow disassembly of control stem 4 (see FIG. 10). This disassembly plate 98 is generally H-shaped and includes a straight segment 100 which extends parallel to longitudinal axis of symmetry X-X of control stem 4 and to which a first and a second transverse piece 102 and 104 are attached. The first transverse piece 102 is also provided at its two free ends with two lugs 106 folded up substantially at right angles. Disassembly plate 98 is received inside a housing 108 provided in lower frame 2 and located underneath control stem 4. This housing 108 communicates with the outside of control device 1 via a hole 110 which opens into a lower face 112 of control device 1 (see FIG. 11). By inserting a pointed tool into hole 110, a thrust force can be exerted on disassembly plate 98 which, via its two lugs 106, in turn pushes position indexing plate 58 against the elastic force of displacement limiting spring 88. Position indexing plate 58 then leaves groove 56 provided in control stem 4 and exerting a slight backward traction on control stem 4 is sufficient to remove the latter from control device 1.

Figure 12A:
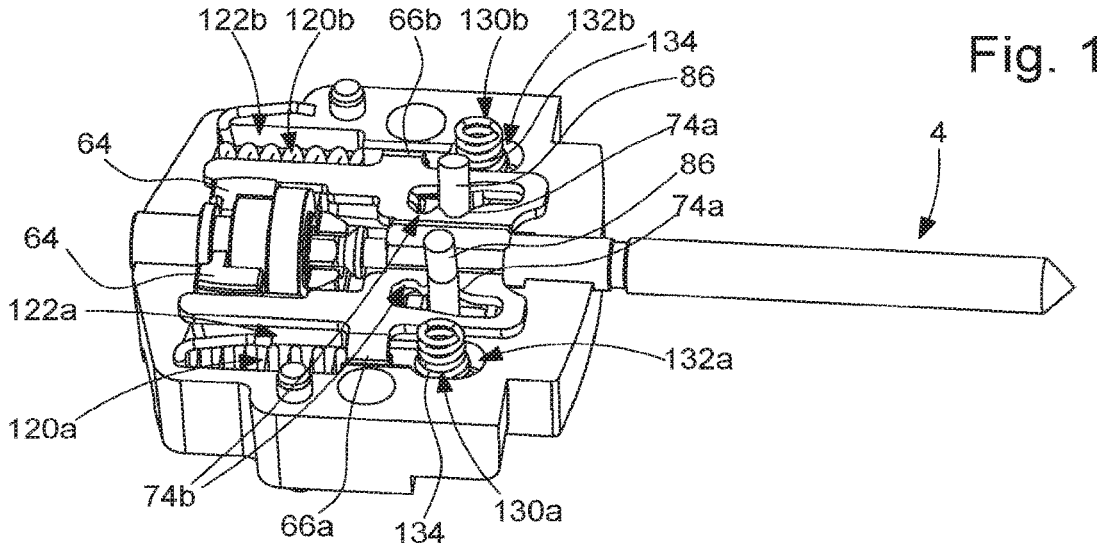
FIG. 12A is a perspective view showing the control stem cooperating with the position indexing plate and the positioning spring, the control stem being in stable position T1.
Figure 12B:
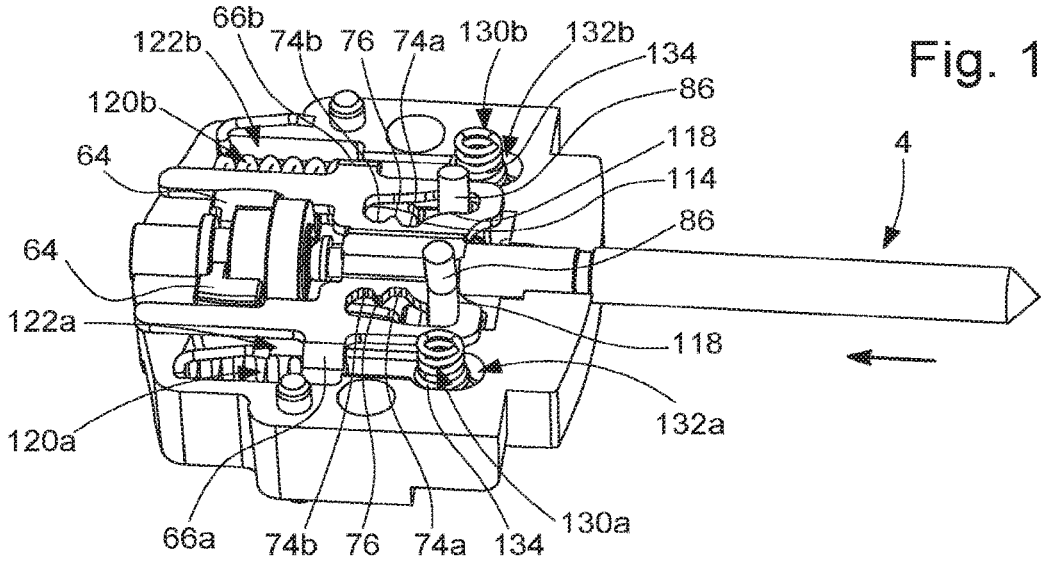
FIG. 12B is a similar view to that of FIG. 12A, with the control stem in an unstable pushed-in position T0.

From its stable rest position T1, control stem 4 can be pushed forwards into an unstable position T0 or pulled out into a stable position T2. These three positions T0, T1 and T2 of control stem 4 are indexed by cooperation between position indexing plate 58 and positioning spring 80. More precisely (see FIG. 12A), the stable rest position T1, in which no commands can be entered into the portable object equipped with control device 1, corresponds to the position in which ends 78 of arms 86 of positioning spring 80 project into first recesses 74*a* of the two apertures 70 provided in guide arms 62 of position indexing plate 58. From this stable rest position T1, control stem 4 can be pushed forwards into an unstable position T0 (see FIG. 12B). During this displacement, ends 78 of arms 86 of positioning spring 80 leave first recesses 74*a* and follow a first ramp profile 114 which gradually moves away from longitudinal axis of symmetry X-X of control stem 4 on a first steep slope α (see FIG. 7B). To force ends 78 of arms 86 of positioning spring 80 to leave first recesses 74*a* and to engage on first ramp profile 114 by moving away from each other, the user must therefore overcome a significant resistance force.

When they reach a transition point 116, ends 78 of arms 86 engage on a second ramp profile 118 which extends first ramp profile 114 with a second slope β lower than first slope α of first ramp profile 114. At the instant that ends 78 of arms 86 of positioning spring 80 cross transition point 116 and engage on second ramp profile 118, the force required from the user to continue moving control stem 4 drops sharply and the user feels a click indicating the transition of control stem 4 between position T1 and position T0. As they follow second ramp profile 118, arms 86 of positioning spring 80 continue to move slightly away from their rest position and tend to try to move towards each other again under the effect of their elastic return force opposing the thrust force exerted by the user on control stem 4. As soon as the user releases pressure on control stem 4, arms 86 of positioning spring 80 will spontaneously return down first ramp profile 114 and their ends 78 will again lodge inside first recesses 74*a* of the two apertures 70 provided in guide arms 62 of position indexing plate 58. Control stem 4 is thus automatically returned from its unstable position T0 to its first stable position T1.

First and second contact springs 120*a* and 120*b* are arranged compressed inside a first and a second cavity 122*a* and 122*b* provided in lower frame 2. These first and second contact springs 120*a* and 120*b* could be helical contact springs, strip-springs or other springs. The two cavities 122*a*, 122*b* preferably, but not necessarily, extend horizontally. Because the two contact springs 120*a*, 120*b* are installed in the compressed state, their positioning precision is dependent on the manufacturing tolerance of lower frame 2. The manufacturing precision of lower frame 2 is higher than the manufacturing precision of these first and second contact springs 120*a*, 120*b*. Consequently, the precision with which position T0 of control stem 4 is detected is high.

Figure 13:
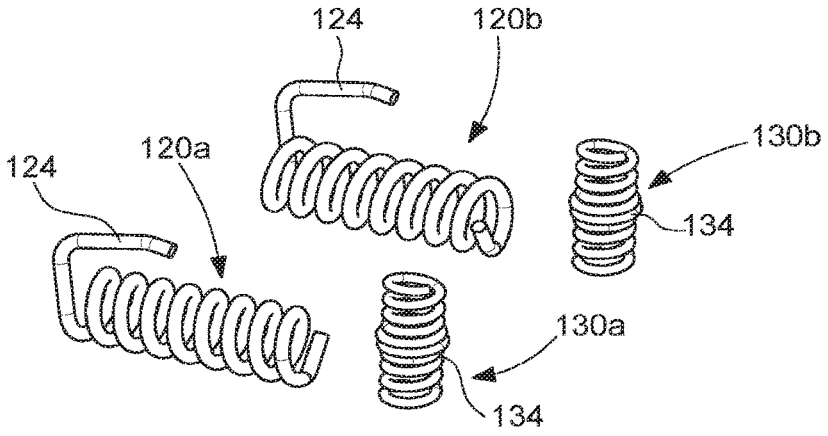
FIG. 13 is a perspective view of the first and second contact springs.
Figure 15:
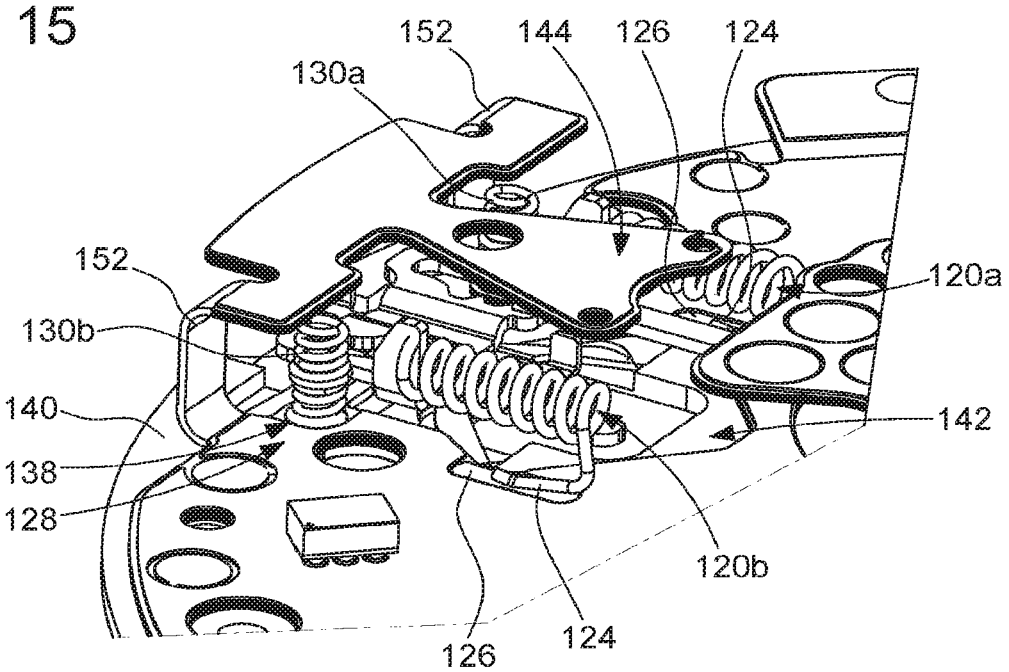
FIG. 15 is a partial, perspective view of the flexible printed circuit sheet on which are arranged the contact pads of first and second contact springs.

As visible in FIGS. 13 and 15, one of the ends of first and second contact springs 120*a*, 120*b* is bent to form two contact lugs 124 which will move into abutment on two corresponding first contact pads 126 provided at the surface of a flexible printed circuit sheet 128. The moment that ends 78 of arms 86 of positioning spring 80 engage on second ramp profile 118 of the two apertures 70 provided in position indexing plate 58 coincides with the moment that fingers 66*a*, 66*b* of position indexing plate 58 come into contact with first and second contact springs 120*a*, 120*b*. Since this position indexing plate 58 is electrically conductive, when fingers 66*a*, 66*b* come into contact with first and second contact springs 120*a*, 120*b*, the electric current passes through position indexing plate 58 and closure of the electrical contact between first and second contact springs 120*a*, 120*b* is detected.

First and second contact springs 120*a*, 120*b* are of the same length. However, preferably, first cavity 122*a* will be, for example, longer than second cavity 122*b*, in particular to take account of tolerance problems (the difference in length between the two cavities 122*a*, 122*b* is several tenths of a millimetre). Thus, when control stem 4 is pushed forwards into position T0, finger 66*a* of position indexing plate 58, which is lined up with first contact spring 120*a* housed inside the first, longest cavity 122*a*, will come into contact with and start to compress first contact spring 120*a*. Control stem 4 will continue to move forward and second finger 66*b* of position indexing plate 58 will come into contact with second contact spring 120*b* housed inside the second, shortest cavity 122*b*. At that moment, position indexing plate 58 will be in contact with first and second contact springs 120*a*, 120*b* and the electric current will flow through position indexing plate 58, which allows the closure of the electrical contact between the first two contact springs 120*a*, 120*b* to be detected. It is noted that fingers 66*a*, 66*b* of position indexing plate 58 move into abutment contact with first and second contact springs 120*a*, 120*b*. There is thus no friction or wear when control stem 4 is pushed forwards into position T0 and closes the circuit between first and second contact springs 120*a*, 120*b*. It is also noted that, the difference in length of first and second cavities 122*a* and 122*b* ensures that closure of the electrical contact and entry of the corresponding command into the portable object equipped with control device 1 occur only after a click is felt.

When the two fingers 66*a*, 66*b* of position indexing plate 58 are in contact with first and second contact springs 120*a*, 120*b*, first contact spring 120*a* housed inside first, longest cavity 122*a* is in a compressed state. Consequently, when the user releases pressure on control stem 4, this first contact spring 120*a* relaxes and forces control stem 4 to return from its unstable pushed-in position T0 to its first stable position T1. The first and second contact springs 120*a*, 120*b* thus act simultaneously as electrical contact parts and elastic return means for control stem 4 in its first stable position T1.

Figure 12C:
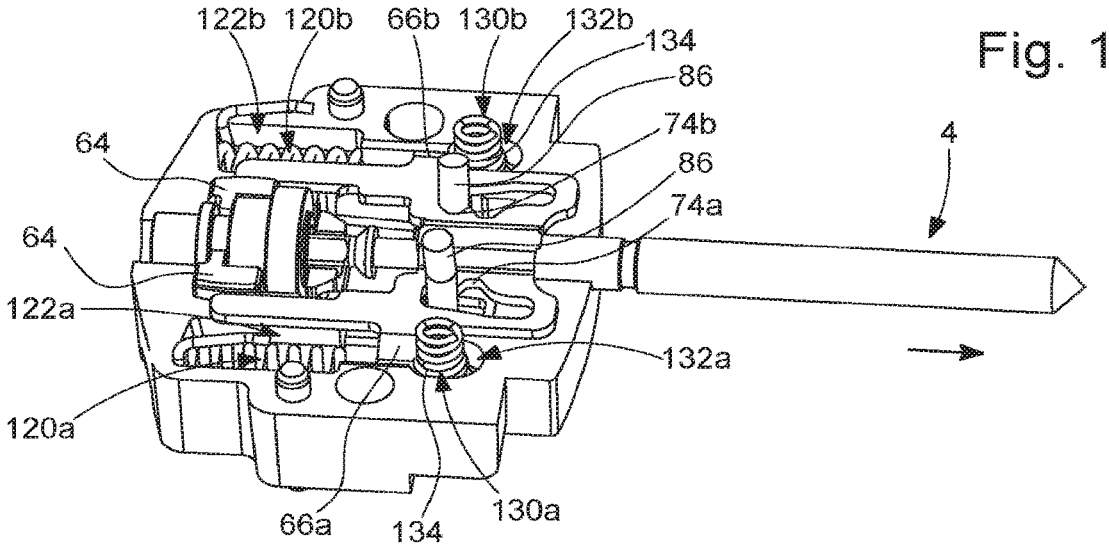
FIG. 12C is a similar view to that of FIG. 12A, with the control stem in stable pulled-out position T2.

From first stable position T1, it is possible to pull control stem 4 backwards into a second stable position T2 (see FIG. 12C). During this movement, ends 78 of arms 86 of positioning spring 80 will elastically deform to pass from first recesses 74*a* to second recesses 74*b*, crossing peaks 76 of the two apertures 70 provided in guide arms 62 of position indexing plate 58. When control stem 4 reaches its second stable position T2, the two fingers 66*a*, 66*b* of position indexing plate 58 move into abutment against third and fourth contact springs 130*a* 130*b* (see FIG. 13), which are housed inside third and fourth cavities 132*a*, 132*b* provided in lower frame 2. These third and fourth contact springs 130*a*, 130*b* could be helical contact springs, strip-springs or other springs. Third and fourth cavities 132*a*, 132*b* preferably extend vertically for reasons of space in control device 1. Since position indexing plate 58 is electrically conductive, when fingers 66*a*, 66*b* come into contact with third and fourth contact springs 130*a*, 130*b*, the electric current flows through position indexing plate 58 and closure of electrical contact T2 between these contact springs 130*a*, 130*b* is detected.

It will be noted that, in the case of stable position T2, fingers 66*a*, 66*b* of position indexing plate 58 also come into abutment contact with third and fourth contact springs 130*a*, 130*b*, thereby avoiding any risk of wear from friction. Further, third and fourth contact springs 130*a*, 130*b* are capable of bending when fingers 66*a*, 66*b* of position indexing plate 58 collide therewith, and therefore of absorbing any lack of precision in the positioning of position indexing plate 58.

Figure 14A:
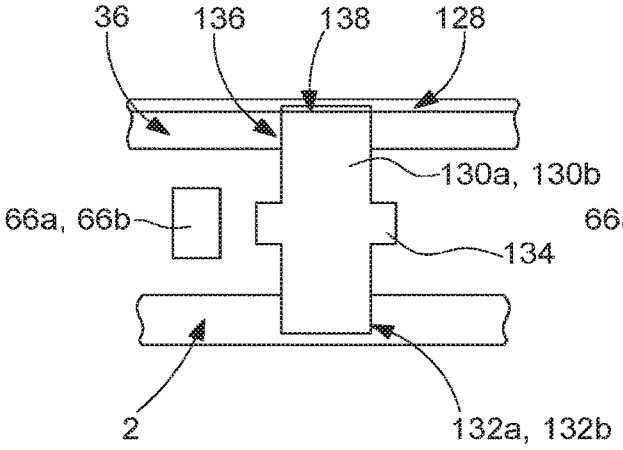
FIGS. 14A and 14B are schematic views that illustrate the cooperation between the fingers of the control stem position indexing plate and third and fourth contact springs.
Figure 14B:
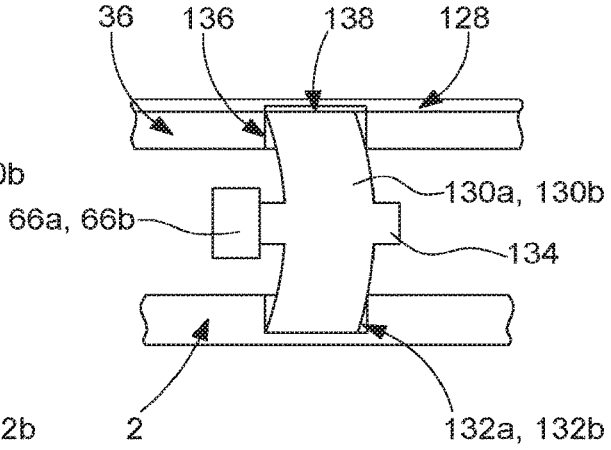

Preferably, but not necessarily, third and fourth contact springs 130*a*, 130*b* are arranged to work in flexion (see FIGS. 14A and 14B). Indeed, with contact springs 130*a*, 130*b* whose diameter is constant, fingers 66*a*, 66*b* of position indexing plate 58 come into contact with contact springs 130*a*, 130*b* over a large surface close to their points of attachment in lower frame 2 and upper frame 36. The proximity of the contact surface to the attachment points of contact springs 130*a*, 130*b* induces shearing stresses in contact springs 130*a*, 130*b* which may lead to premature wear and breakage of the latter. To overcome this problem, contact springs 130*a*, 130*b* have, preferably substantially at mid-height, an increase in diameter 134 which comes into contact with fingers 66*a*, 66*b* of position indexing plate 58 when control stem 4 is pulled into its stable position T2. At their upper end, third and fourth contact springs 130*a*, 130*b* are guided in two holes 136 provided in upper frame 36 and come into contact with second contact pads 138 provided at the surface of flexible printed circuit sheet 128. It is clear that, when control stem 4 is pulled backwards into its stable position T2, fingers 66*a*, 66*b* of positioning indexing plate 58 come into contact on a reduced surface with third and fourth contact springs 130*a* and 130*b* at their largest diameter 134, which allows contact springs 130*a*, 130*b* to bend between their two points of attachment in lower frame 2 and upper frame 36.

Figure 16:
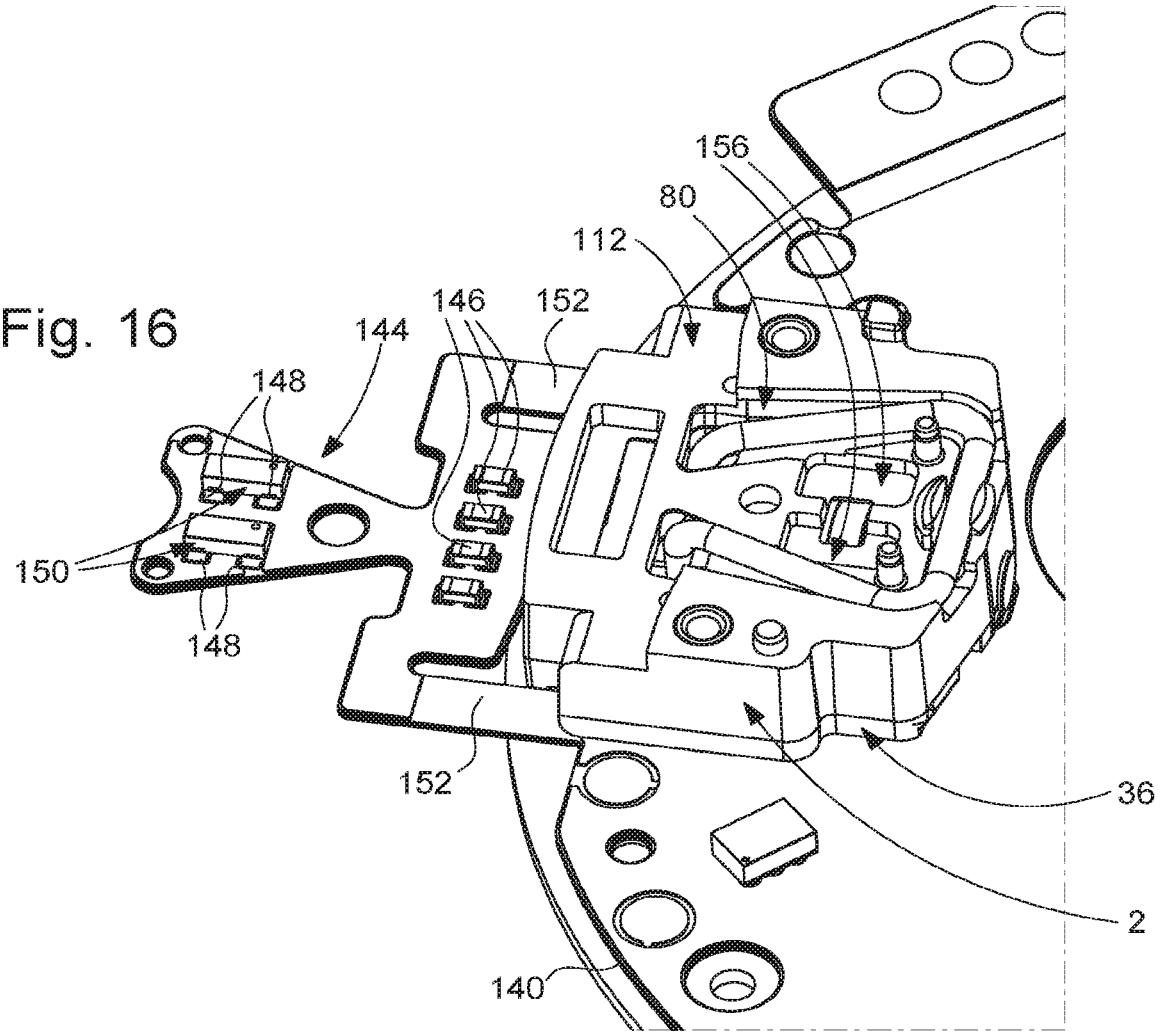
FIG. 16 is a perspective view of the free portion of the flexible printed circuit sheet on which are fixed the inductive sensors.

In FIG. 15, lower and upper frames 2 and 36 have been deliberately omitted to facilitate understanding of the drawing. As represented in FIG. 15, flexible printed circuit sheet 128 is fixed on a plate 140 located on the dial side of the portable object. It takes the form, in particular, of a cutout 142 adapted in shape and size to receive upper frame 36. One portion 144 of flexible printed circuit sheet 128 remains free (see FIG. 16). This free portion 144 of flexible printed circuit sheet 128 carries a plurality of electronic components 146, in addition to third contact pads 148, on which are fixed at least one and, in the example represented, two inductive sensors 150. Fixing inductive sensors 150 to third contact pads 148 allows these inductive sensors 150 to be connected, via flexible printed circuit sheet 128, to a power source and to a microprocessor (not represented) housed inside the portable object. The power source will supply inductive sensors 150 with the energy required to operate, and the microprocessor will receive and process the signals supplied by inductive sensors 150.

The free portion 144 of flexible printed circuit sheet 128 is connected to the rest of flexible printed circuit sheet 128 by two strips 152, which allow free portion 144 to be folded around the assembly of upper frame 36 and lower frame 2, and then folded down against lower face 112 of lower frame 2, so that inductive sensors 150 penetrate two housings 156 arranged in lower surface 112 of lower frame 2. Thus positioned inside their housings 156, inductive sensors 150 are precisely located under magnetized ring 18, which ensures reliable detection of the direction of rotation of control stem 4.

Figure 17A:
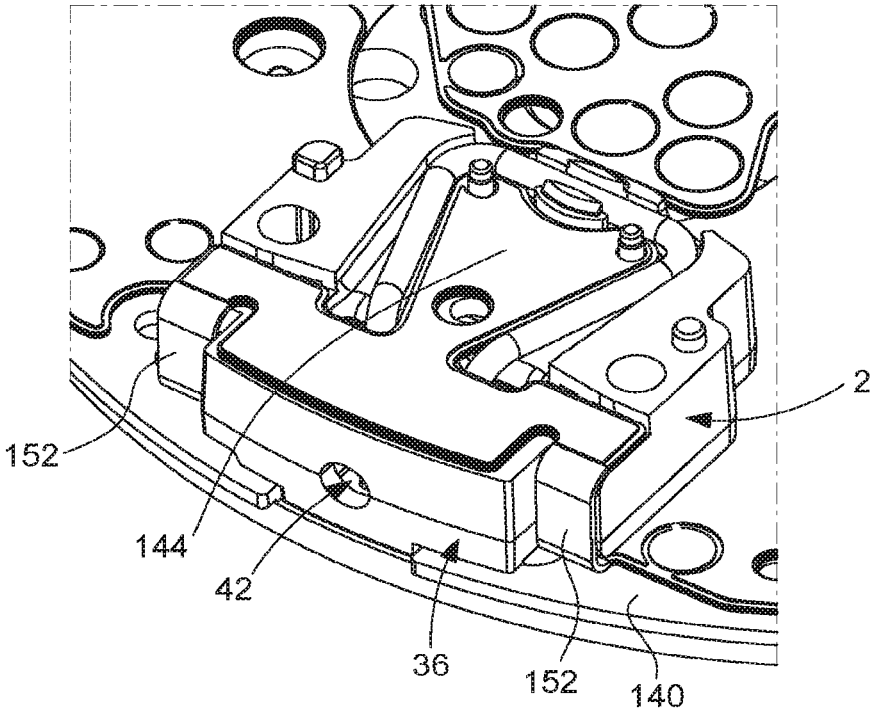
FIG. 17A is a perspective view of the control device, onto a rear face of which is folded the free portion of the flexible printed sheet.
Figure 17B:
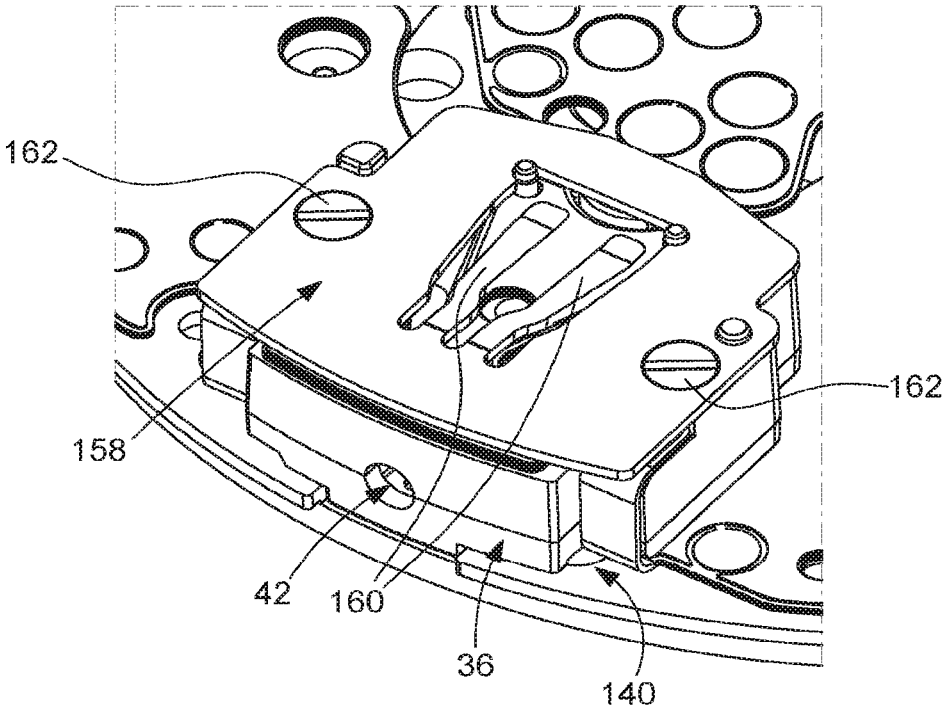
FIG. 17B is a perspective view of the control device, onto a rear face of which the free portion of the flexible printed circuit sheet is folded and held by means of a holding plate fixed by screws to the control device.

Once free portion 144 of flexible printed circuit sheet 128 has been folded down against lower frame 2 (see FIG. 17A), the assembly is covered by a holding plate 158, provided with at least one elastic finger 160 (two in the example represented), which exerts on inductive sensors 150 an elastic pressure force directed vertically upwards so as to press these inductive sensors 150 against the bottom of their housings 156 (see FIG. 17B). Elastic fingers 160 press on flexible printed circuit 128 preferably at the place where inductive sensors 150 are fixed. Holding plate 158 is fixed to plate 140, for example by means of two screws 162.

Figure 18:
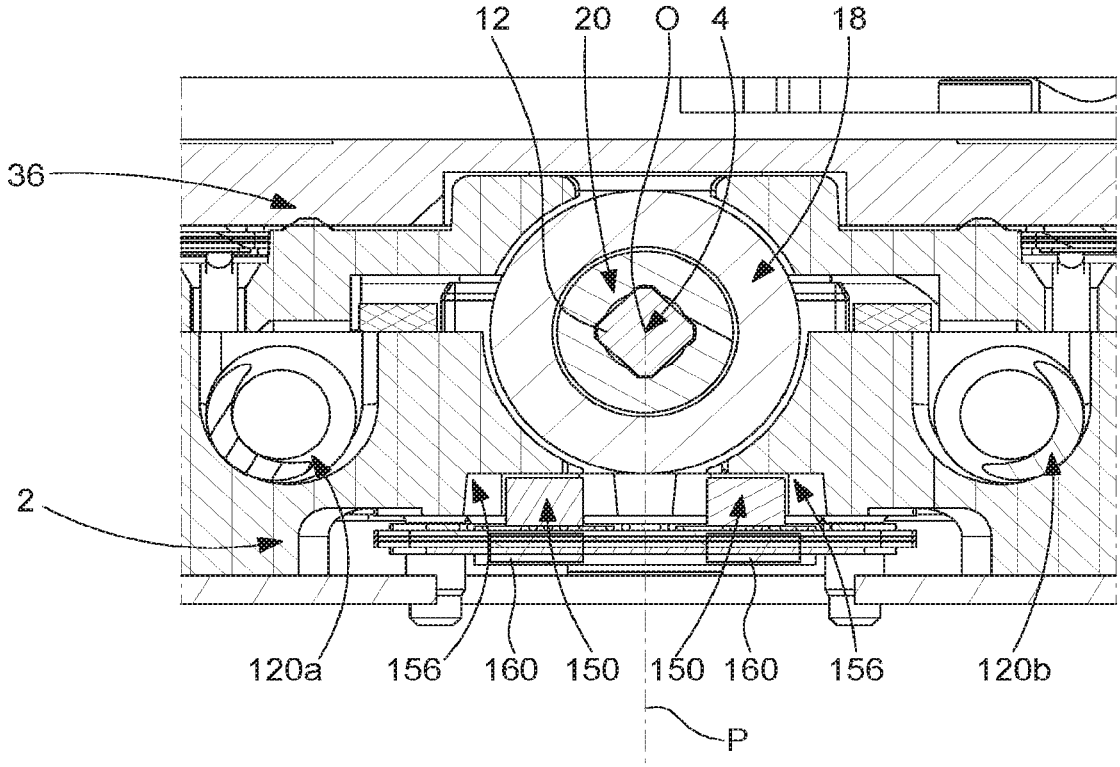
FIG. 18 is an elevation view of the system for detecting the position of the magnetized ring by means of two inductive sensors.

Control stem 4 is carried by lower frame 2 which acts as a cradle. Likewise, the two inductive sensors 150 are disposed inside two housings 156 provided in said lower frame 2, and are pressed against the bottom of these housings 156 by one or two elastic fingers 160 (see FIG. 18). Consequently, the relative positioning precision of inductive sensors 150 and magnetized ring 18, which is rotationally fixedly mounted relative to control stem 4, is determined only by the precision with which lower frame 2 is made. The manufacturing precision of lower frame 2, which is for example made of injected plastic, is sufficient to guarantee the proper positioning of inductive sensors 150 and of magnetized ring 18, even in the case of large scale production. Further, since inductive sensors 150 are elastically forced against the bottom of housings 156 by elastic finger(s) 160, this makes it possible to compensate for any play resulting from manufacturing tolerances. These manufacturing tolerances may, in particular, result from the step of soldering Hall-effect components 150 on flexible printed circuit sheet 128. This soldering operation is performed, for example, in a furnace using a soldering paste deposited on contact pads 148 of flexible printed circuit sheet 128.

Figure 22:
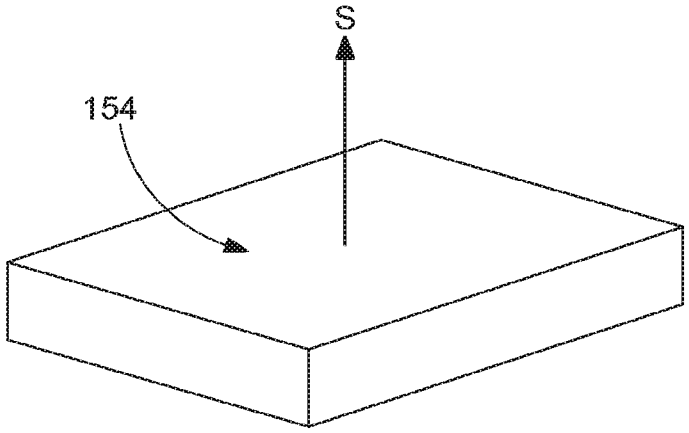
FIG. 22 is a schematic, perspective view of the sensing element of an inductive sensor and of the direction in which this element is sensitive to fluctuations in magnetic induction.

Inductive sensor or sensors 150 each include a sensing element 154 which, in a simplified manner, takes the form of a parallelepiped element sensitive to fluctuations in magnetic induction in a direction S perpendicular to the large side of the parallelepiped (see FIG. 22). In the example illustrated in FIG. 18, inductive sensors 150 are preferably oriented such that their sensing element 154 detects a fluctuation in magnetic induction only in vertical direction z. In other words, the inductive sensors are completely insensitive to horizontal components along the orthogonal x and y axes of magnetic induction.

Figure 19:
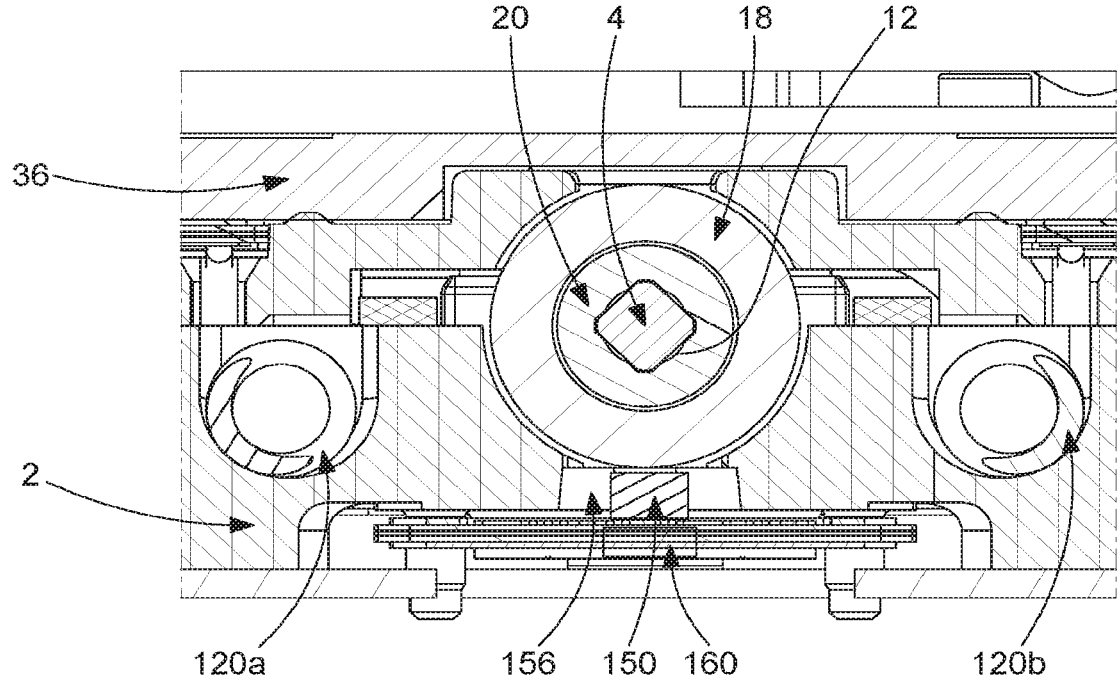
FIG. 19 is an elevation view of the system for detecting rotation of the magnetized ring by means of a single inductive sensor.

In the case where a single inductive sensor 150 is provided (see FIG. 19), the amplitude of rotation and the position of control stem 4 may be determined with only average precision. Indeed, when magnetized ring 18 rotates as a result of actuation of control stem 4, inductive sensor 150 produces a sinusoidal signal whose amplitude of variation fluctuates according to the value of the angle concerned. In an area close to the value $\pi/2$, for example, the sinusoidal signal varies very little, so that control stem 4 can be rotated to quite a large extent without any significant modification in the signal provided by inductive sensor 150. The position and displacement of control stem 4 can therefore only be detected with average precision. However, within an area close to value $\pi$, the sinusoidal signal fluctuates sharply, such that the amount of rotation and the position of control stem 4 can be determined with high precision. In the case where one can be satisfied with average precision in the detection of the position and amount of rotation of control stem 4, the system described above is entirely suitable. However, in the case where very high measurement precision is required, it is preferable to equip the portable object according to the invention with two inductive sensors 150 (see FIG. 18). Indeed, by providing for the use of two inductive sensors 150, it is possible to determine both the amplitude and the direction of rotation of control stem 4 with increased precision. Thus, the two inductive sensors 150 are arranged at an equal distance from the centre of rotation O of magnetized ring 18, symmetrically with respect to a plane P passing through the centre of rotation O of magnetized ring 18. Preferably, the two inductive sensors 150 are arranged with respect to control stem 4 such that, when magnetized ring 18 rotates as a result of actuation of control stem 4, the two inductive sensors 150 produce sinusoidal signals sin(x) and sin(x+δ) that are out of phase relative to each other by an angle δ comprised between 60° and 120°, and preferably equal to 90°. To calculate the relative arrangement of the two inductive sensors and magnetized ring 18, it is possible, for example, to perform successive iterations by means of finite element calculation software.

Owing to the phase shift δ between the sinusoidal measurement signals sin(x) and sin(x+δ) produced by the two inductive sensors 150, when the arctangent function of the ratio between these two measurement signals is calculated, a straight line is obtained. Consequently, it is possible, from a rotary motion of control stem 4, to obtain a linear response from the system formed by control stem 4, magnetized ring 18 and the two inductive sensors 150. This linearization of the rotation of control stem 4 advantageously permits absolute detection of the position of control stem 4. In other words, it is possible at any time to know the direction of rotation and the position of control stem 4. Further, owing to phase shift δ, there is constantly a situation where, when sinusoidal measurement signal sin (x) produced by one of the two inductive sensors 150 varies slightly, the other sinusoidal signal sin(x+δ) varies more sharply and vice versa, such that the ratio between these two signals always gives precise information about the rotation of control stem 4.

It was mentioned above that inductive sensors 150 were preferably oriented such that their sensing element only detects fluctuations in magnetic induction along the vertical axis z. This component of magnetic induction is the sum of inductions along axis z generated by magnetized ring 18 and by the magnetic field outside the portable object. However, given that inductive sensors 150 are very close to each other, the influence exercised thereon by the external magnetic field is substantially the same for both inductive sensors 150. Consequently, calculating the ratio between the two sinusoidal signals sin(x) and sin(x+δ) eliminates the component of magnetic induction due to the magnetic field outside the portable object. The response of the system formed by control stem 4, magnetized ring 18 and inductive sensors 150 is thus totally independent of the external magnetic field, and it is not necessary to take steps to magnetically shield the portable object. Likewise, the response of the system is independent of temperature insofar as the temperature has the same effect on both inductive sensors.

It goes without saying that the present invention is not limited to the embodiment that has just been described and that various simple modifications and variants can be envisaged by those skilled in the art without departing from the scope of the invention as defined by the annexed claims. In particular, the magnetized ring concerned here is preferably a bipolar ring but it may also be a multipolar magnetized ring. The dimensions of the magnetized ring could also be extended so that it corresponds to a hollow cylinder.

NOMENCLATURE

1. Control device
2. Lower frame
4. Control stem
X-X. Longitudinal axis of symmetry
6. Rear end
8. Actuation crown
10. Front end
12. Square section
14. Magnetic assembly
16. Smooth bearing
18. Magnetized ring
20. Support ring
22*a* First section
D1. First external diameter
22*b*. Second section
D2. Second external diameter
24. Shoulder
26. Square hole
28. Cylindrical housing
D3. First internal diameter
30. Annular hole
D4. Second internal diameter
D5. Third external diameter
32. Circular collar
34*a* First groove
34*b*. Second groove
36. Upper frame
38. First receiving surface

40. Second receiving surface
42. Hole
44*a*, 46*a* Third and fourth undercut surfaces
44*b*, 46*b* Complementary undercut surfaces
48. Case middle
49. Back
50. Annular collar
52. Cylindrical section
54. Back section
56. Groove
58. Position indexing plate
60. Curved portion
62. Guide arm
64. Studs
66*a*, 66*b* Fingers
68. Rim
70. Apertures
72. Profile
74*a* First recess
74*b*. Second recess
76. Peak
78. Ends
80. Positioning spring
82. Arms
84. Base
86. Arbors
88. Displacement limiting spring
90. Central portion
92. Pair of elastic arms
94. Pair of elastic arms
96. Stiff lugs
98. Disassembly plate
100. Straight segment
102. First crosspiece
104. Second crosspiece
106. Lugs
108. Housing
110. Hole
112. Lower face
114. First ramp profile
α First slope
116. Transition point
118. Second ramp profile
β Second slope
120*a*, 120*b* First and second contact spring
122*a*, 122*b* First and second cavity
124. Contact lugs
126. First contact pads
128. Flexible printed circuit sheet
130*a*, 130*b* Third and fourth contact springs
132*a*, 132*b* Third and fourth cavities
134. Increase in diameter
136. Holes
138. Second contact pads
140. Plate
142. Cutout
144. Free portion
146. Electronic components
148. Third contact pads
150. Inductive sensors
152. Strips
154. Sensing element
156. Housings
158. Holding plate
160. Elastic fingers
162. Screws

The invention claimed is:

1. A portable object comprising:

a control stem, actuation of which in rotation can control at least one electronic or mechanical function of the portable object;

a magnetized ring driven in rotation by the control stem; and two inductive sensors configured to detect a rotation of the control stem and a position of the control stem, the two inductive sensors configured to be sensitive to a variation in magnetic induction produced by rotation of the magnetized ring in only two directions in space, which are parallel to each other, wherein the two inductive sensors are arranged at an equal distance from a center of rotation of the magnetized ring, symmetrically with respect to a plane passing through the center of rotation of the magnetized ring.

2. The portable object according to claim 1, wherein the two inductive sensors are sensitive to a variation in magnetic induction only in a vertical direction.

3. The portable object according to claim 1, wherein the two inductive sensors are arranged with respect to the control stem such that, when the magnetized ring rotates as a result of actuation of the control stem, the two inductive sensors produce signals that are phase shifted with respect to each other by a value between 60° and 120°.

4. The portable object according to claim 2, wherein the two inductive sensors are arranged with respect to the control stem such that, when the magnetized ring rotates as a result of actuation of the control stem, the two inductive sensors produce signals that are phase shifted with respect to each other by a value between 60° and 120°.

5. The portable object according to claim 1, wherein the object includes a frame configured to serve as a cradle for the control stem, the inductive sensors being disposed inside at least one housing arranged in the frame inside which the sensors are held by an elastic device.

6. The portable object according to claim 5, wherein the two inductive sensors are disposed inside two distinct housings arranged in the frame.

7. The portable object according to claim 5, wherein the portable object includes a holding plate including at least one elastic finger which, by pressure on the inductive sensors, holds the inductive sensors inside at least one housing in which the sensors are disposed.

8. The portable object according to claim 6, wherein the portable object includes a holding plate including at least one elastic finger which, by pressure on the inductive sensors, holds the inductive sensors inside at least one housing in which the sensors are disposed.

9. The portable object according to claim 7, wherein the holding plate includes two elastic fingers and the inductive sensors are fixed to a printed circuit sheet on which the elastic fingers press at locations where the inductive sensors are fixed.

10. The portable object according to claim 8, wherein the holding plate includes two elastic fingers and the inductive sensors are fixed to a printed circuit sheet on which the elastic fingers press at locations where the inductive sensors are fixed.

11. The portable object according to claim 9, wherein the printed circuit sheet is flexible and the sheet is folded down onto the frame such that the inductive sensors are disposed inside the housings.

12. The portable object according to claim 10, wherein the printed circuit sheet is flexible and the sheet is folded down onto the frame such that the inductive sensors are disposed inside the housings.

13. The portable object according to claim 11, wherein the elastic fingers immobilize the inductive sensors in a vertical direction.

14. The portable object according to claim 12, wherein the elastic fingers immobilize the inductive sensors in a vertical direction.

15. The portable object according to claim 13, wherein the elastic fingers are configured to force the inductive sensors against a bottom of the housings inside which the sensors are disposed.

16. The portable object according to claim 14, wherein the elastic fingers are configured to force the inductive sensors against a bottom of the housings inside which the sensors are disposed.

17. A method for detecting a position of a control stem, actuation of which in rotation controls at least an electronic or mechanical function of a portable object including the control stein, a magnetized ring driven in rotation by the control stem, the rotation of the control stein and the position of the control stem being detected by two inductive sensors configured to be sensitive to a variation in magnetic induction produced by rotation of the magnetized ring in only one direction in space, the two inductive sensors being arranged at an equal distance from a center of rotation of the magnetized ring, symmetrically with respect to a plane passing through the center of rotation of the magnetized ring, the method comprising:

calculating an arctangent function of the ratio between signals produced by each of the inductive sensors to determine a direction of rotation and a position of the control stem.

* * * * *